US007264125B2

(12) United States Patent
Lipa

(10) Patent No.: US 7,264,125 B2
(45) Date of Patent: Sep. 4, 2007

(54) UNDULATING MOLDED PLASTIC VIBRATORY SCREEN

(75) Inventor: Anthony J. Lipa, Williamsville, NY (US)

(73) Assignee: Derrick Corporation, Buffalo, NY (US)

( * ) Notice: Subject to any disclaimer, the term of this patent is extended or adjusted under 35 U.S.C. 154(b) by 0 days.

(21) Appl. No.: 10/421,042

(22) Filed: Apr. 23, 2003

(65) Prior Publication Data

US 2004/0211707 A1 Oct. 28, 2004

(51) Int. Cl.
*B07B 1/46* (2006.01)

(52) U.S. Cl. ..... 209/397; 209/392

(58) Field of Classification Search ..... 209/392, 209/397, 399; 210/388, 493.1, 493.2, 493.3
See application file for complete search history.

(56) References Cited

U.S. PATENT DOCUMENTS 500,302 A * 6/1893 Stoeckel et al. ..... 209/399
1,098,979 A * 6/1914 Schuchard ..... 209/457
4,517,090 A * 5/1985 Kersten et al. ..... 210/493.2
4,819,809 A 4/1989 Derrick
4,857,176 A 8/1989 Derrick et al.
5,417,859 A 5/1995 Bakula
5,490,598 A * 2/1996 Adams ..... 209/401
5,598,930 A * 2/1997 Leone et al. ..... 209/403
5,944,993 A * 8/1999 Derrick et al. ..... 210/388
6,032,806 A * 3/2000 Leone et al. ..... 209/402
6,454,099 B1 * 9/2002 Adams et al. ..... 209/399
6,530,483 B2 * 3/2003 Schulte et al. ..... 209/399
6,629,610 B1 * 10/2003 Adams et al. ..... 209/399

* cited by examiner

*Primary Examiner*—Joseph Rodriguez
(74) *Attorney, Agent, or Firm*—Kenyon & Kenyon LLP

(57) ABSTRACT

An undulating molded plastic vibratory screen including a base, a plurality of spaced substantially parallel undulations on the base, screen configurations on the undulations, and supporting rib structure within the undulations.

24 Claims, 9 Drawing Sheets

UNDULATING MOLDED PLASTIC VIBRATORY SCREEN

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to an undulating molded plastic vibratory screen for a vibratory screening machine.

By way of background, molded planar plastic vibratory screens are known in the art, as exemplified by U.S. Pat. Nos. 4,819,809 and 4,857,176. Also, undulating metal vibratory screens are also known in the art as exemplified by Pat. No. 5,417,859. However, it is not known that the prior art includes undulating molded plastic vibratory screens for vibratory screening machines.

BRIEF SUMMARY OF THE INVENTION

It is one object of the present invention to provide a molded plastic undulating screen for a vibratory screening machine.

It is another object of the present invention to provide an undulating molded plastic vibratory screen which has good structural stability because of a unique rib structure associated with the undulations.

Another object of the present invention is to provide an undulating molded plastic vibratory screen which can be made by a single molding process thereby obviating the plurality of procedures needed for making an undulating vibratory metal screen, namely, fabrication of the screening material, bending the metal screening material, fabricating an apertured metal backing plate, and bonding the bent metal screening material to the apertured metal backing plate. Other objects and attendant advantages of the present invention will readily be perceived hereafter.

The present invention relates to an undulating molded plastic vibratory screen comprising a base, a plurality of spaced substantially parallel elongated undulations on said base, and screen configurations on said undulations.

The various aspects of the present invention will be more fully understood when the following portions of the specification are read in conjunction with the accompanying drawings wherein:

DETAILED DESCRIPTION OF THE INVENTION

Figure 1:
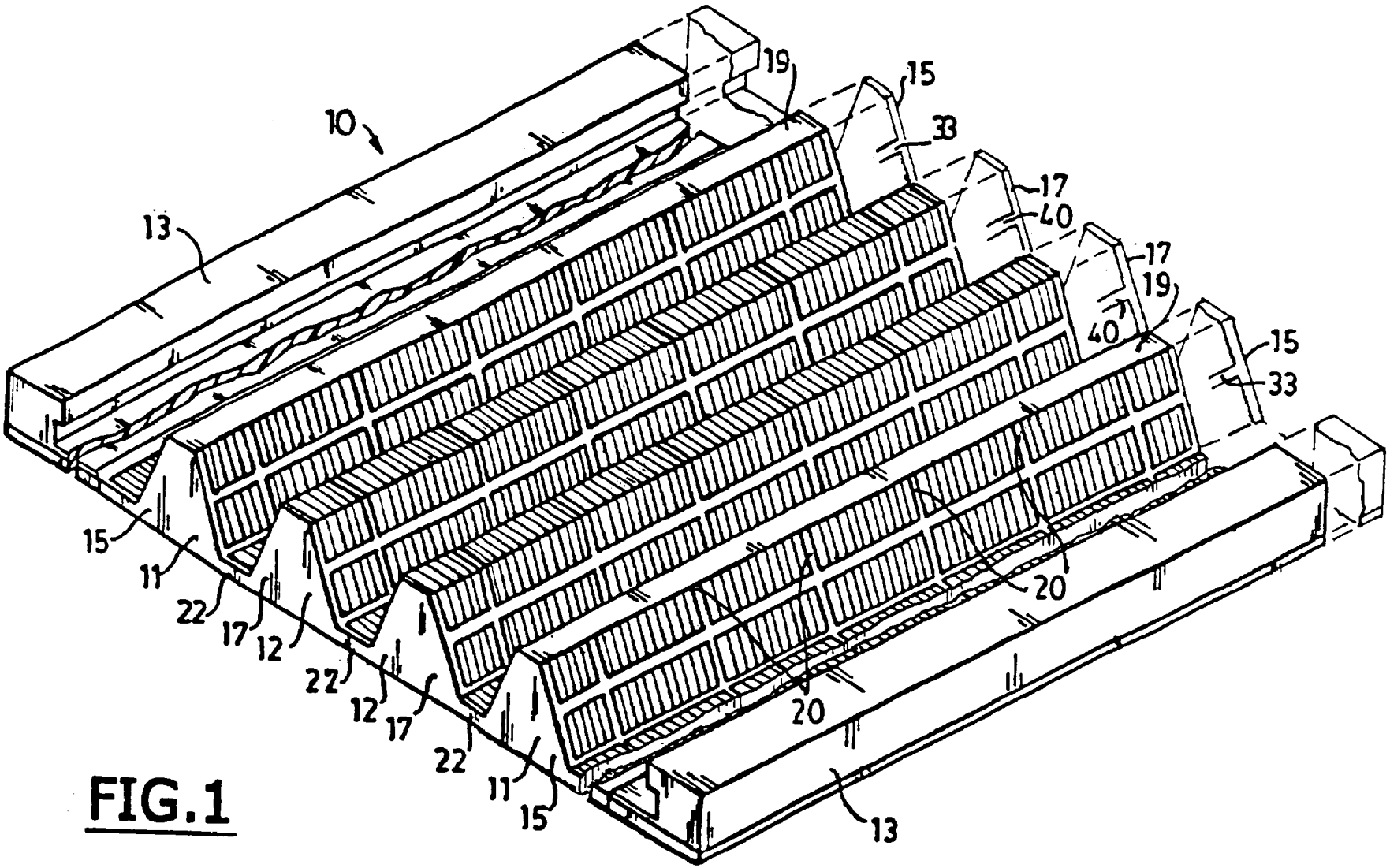
FIG. 1 is a fragmentary perspective view of the plastic undulating screen of the present invention.
Figure 2:
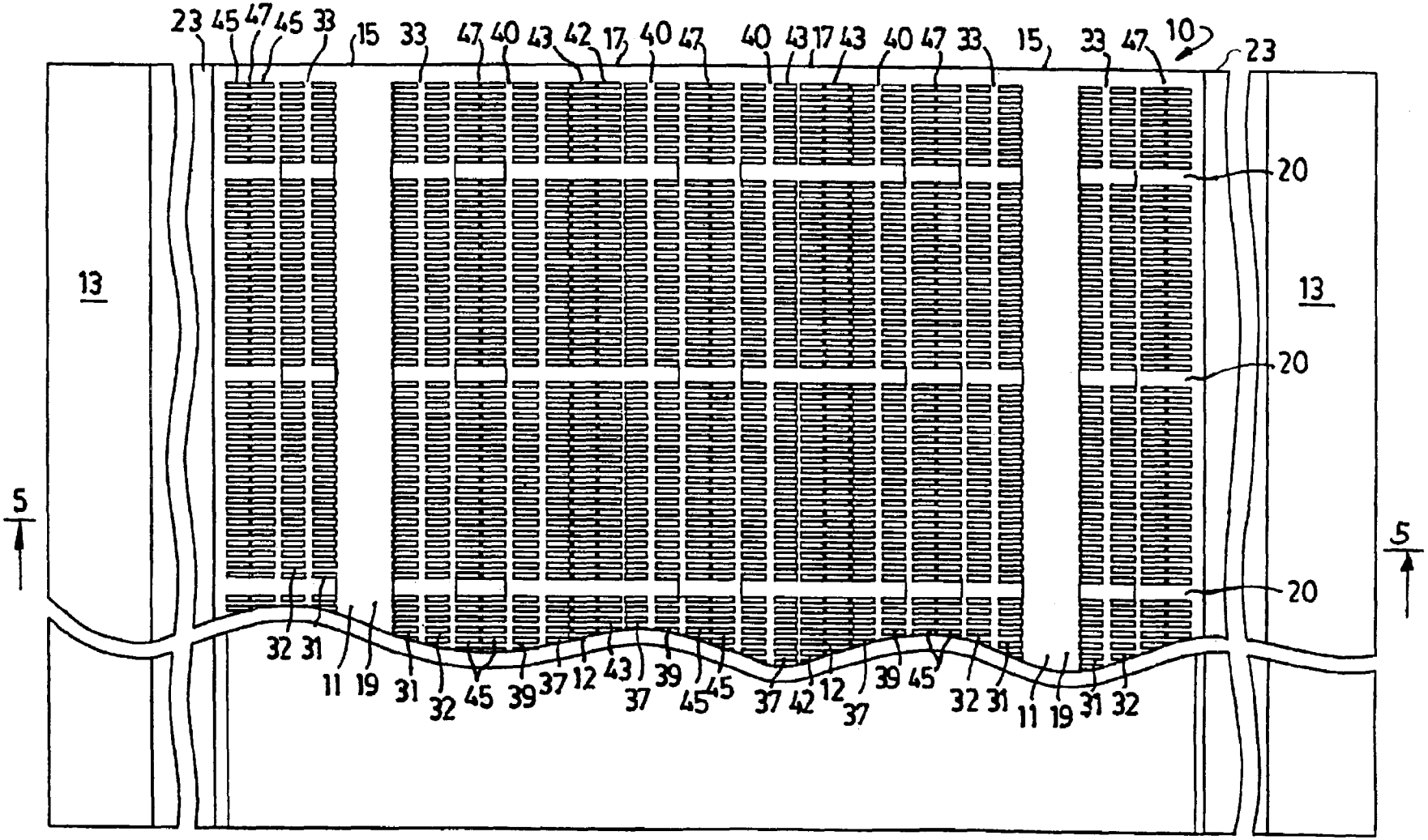
FIG. 2 is an enlarged fragmentary top plan view of the undulating screen of FIG. 1.

The undulating molded plastic vibratory screen 10 of the present invention includes a plurality of major structural undulations 11 (FIGS. 1-6, 8 and 10) and a plurality of minor structural undulations 12 (FIGS. 1-5, 7, 9 and 11). The major undulations 11 are interspersed with the minor undulations 12 (FIGS. 1-5), and there are connecting portions 22 between the undulations 11 and 12. At the outer side edges of the screen, the plastic is formed into channel configurations 13 which have reinforcing metal angle members 14 (FIG. 5) molded therein which extend throughout the entire lengths of the screen sides. The channels 13 are for receiving channel-shaped tensioning members of a vibratory screening machine, as is well known in the art.

The screen 10 is molded in one piece, thereby obviating the labor and materials required for producing metal vibratory undulating screens. Screen 10 is of a size to fit across the bed of a vibratory screening machine. The screen is molded from MDI polyether type of polyurethane, but it will be appreciated that it can be molded of any suitable plastic. Both ends of each major structural undulation 11 are closed by integrally molded end caps 15, and the ends of minor structural undulations 12 are closed by integrally molded end caps 17. The outer dimensions of the major and minor undulations are the same. The major undulations have a more substantial internal rib structure than the minor undulations 12, as will become apparent hereafter. This is why the undulations 11 are termed major undulations and the undulations 12 are termed minor undulations. It will be appreciated, however, if desired, all of the undulations may be of the major undulation type.

The structural stability of the undulating molded plastic screen is achieved in part by a base 16 (FIGS. 3, and 5-7) consisting of a grid of major ribs 19 (FIGS. 1-3, 5, 6, 8 and 10) and minor ribs 20 (FIGS. 1-3, 5-7 and 10) which extend crosswise to and are molded integrally with major ribs 19.

Figure 5:
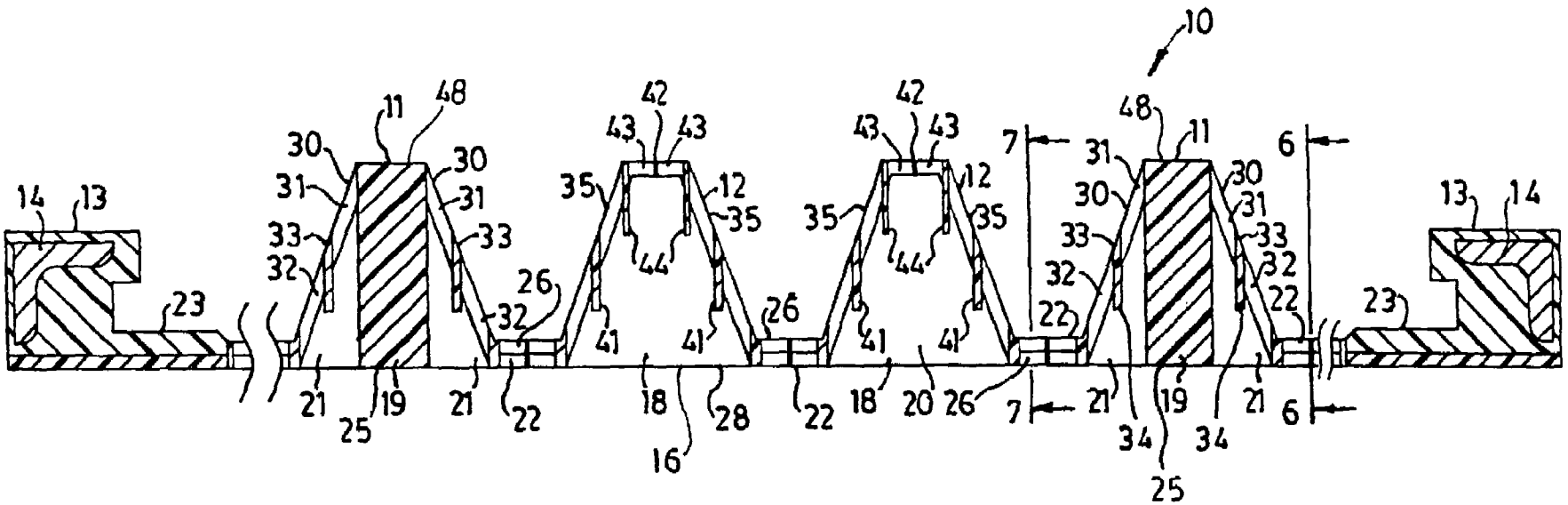
FIG. 5 is an enlarged fragmentary cross sectional view taken substantially along line 5-5 of FIG. 2 and showing the internal rib structures of the undulations.
Figure 6:
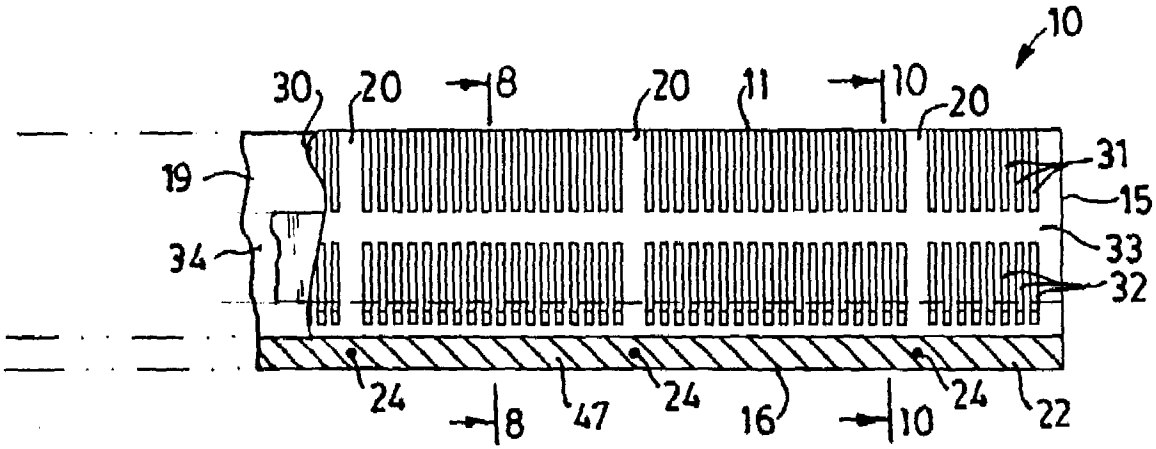
FIG. 6 is a partially broken-away fragmentary cross sectional view taken substantially along line 6-6 of FIG. 5 and showing the outer side and the rib structure of a major structural undulation.
Figure 7:
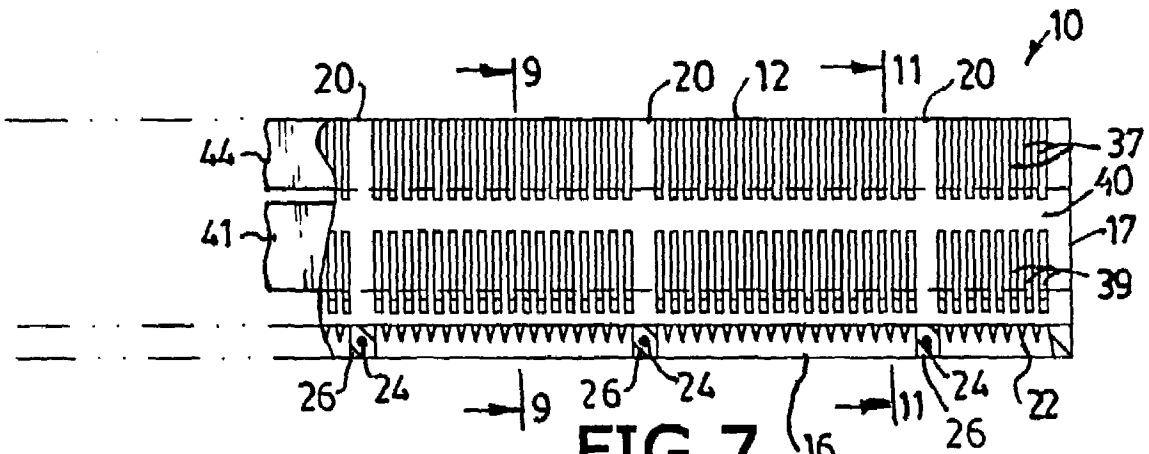
FIG. 7 is a partially broken-away fragmentary cross sectional view taken substantially along line 7-7 of FIG. 5 and showing the outer side and the rib structure of a minor structural undulation.
Figure 8:
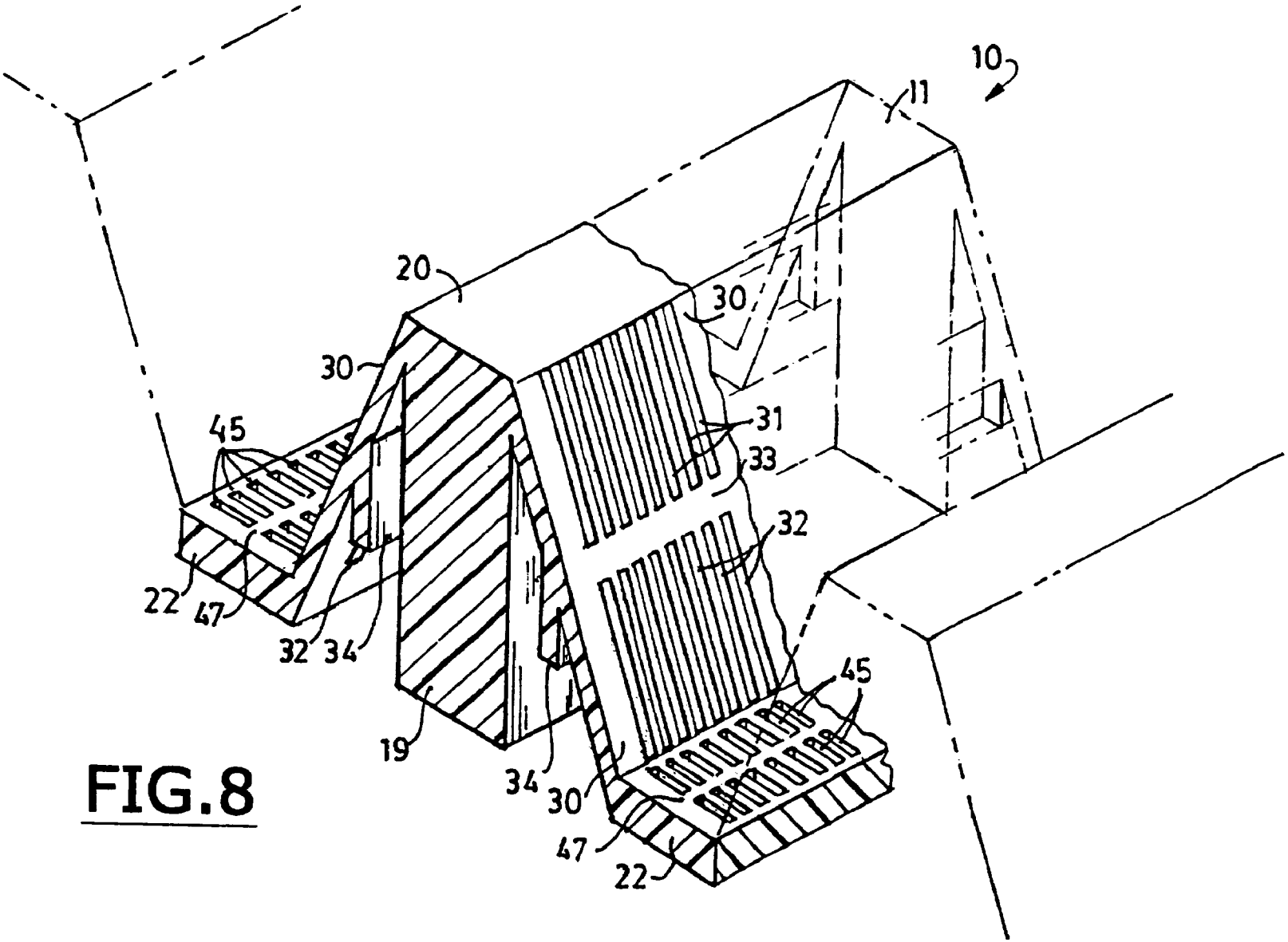
FIG. 8 is an enlarged fragmentary perspective cross sectional view of a major structural undulation with the rib structure therein taken substantially along line 8-8 of FIG. 6.
Figure 11:
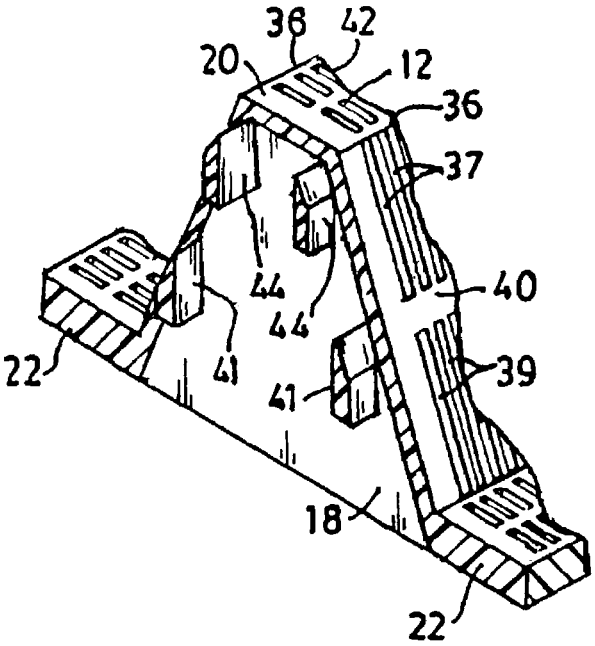
FIG. 11 is an enlarged fragmentary cross sectional view of a minor structural undulation with the rib structure therein taken substantially along line 11-11 of FIG. 7 and with the sides of the minor undulation cross-sectioned immediately prior to their intersection with the minor ribs.

The major ribs 19 are of solid rectangular cross section and extend lengthwise of major structural undulations 11. The minor ribs 20 pass through both the major undulations 11 and minor undulations 12. In the minor structural undulations 12, the portions of the minor ribs 20 are in the shapes of trapezoids 18 (FIGS. 5 and 11). In the major structural undulations 11, the minor ribs 20 are in the shapes of right triangles 21 (FIGS. 5 and 10) where they are molded integrally with major ribs 19. As can be seen from FIGS. 1 and 5, both the major undulations 11 and the minor undulations 12 are in the cross sectional shape of trapezoids. However, it will be appreciated that they can be molded in other cross sectional shapes such as curved domes. As can be seen from FIG. 5, the adjacent portions 18 of adjacent minor ribs 12 and the adjacent portions 21 and 18 of the major and minor ribs, respectively, are connected by connecting portions 26 of the minor ribs 20. Where the connecting portions 26 of the minor ribs 20 pass between the undulations 12 and between the undulations 11 and 12, they are the full thickness shown in FIG. 7. The minor ribs 20 extend substantially across the entire width of the screen, and at their ends they merge into planar portions 23 which in turn merge into channel-shaped portions 13.

Figure 3:
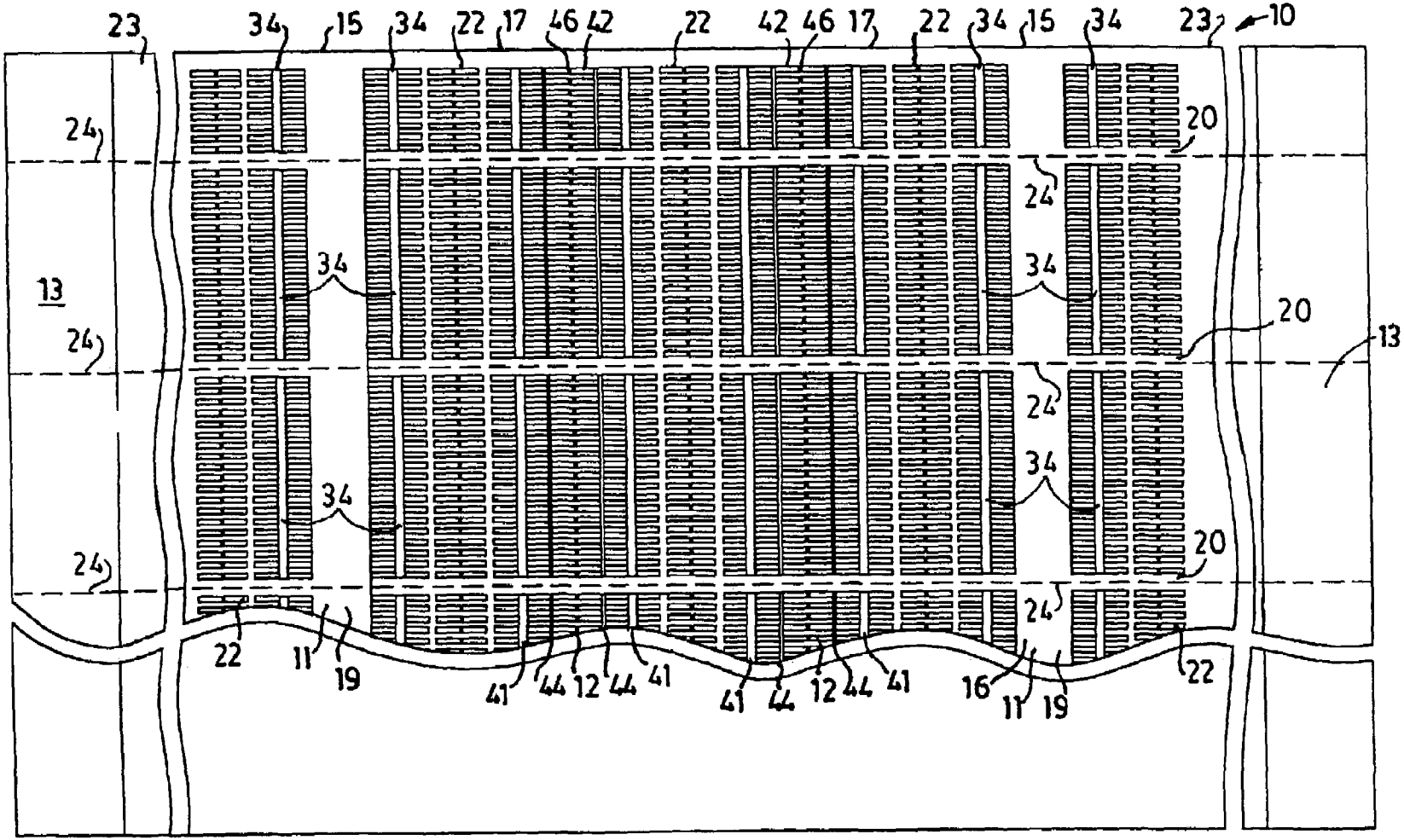
FIG. 3 is an enlarged bottom plan view of the undulating screen of FIG. 1.

Aramid cords 24 (FIGS. 3, 6 and 7) are molded integrally with the lowermost portions of minor ribs 20, and they extend as shown in FIG. 3 across the entire width of the screen between channel portions 13. More specifically, each cord 24 extends through (1) the lowermost parts of the minor rib trapezoids 18, (2) the lowermost parts of the minor rib triangles 21, (3) the lowermost parts of the major ribs 19 and (4) the portions 26 of minor ribs 20. The aramid cords 24 reinforce the screen 10 against undesirable stretching when it is tensioned in use. The lower edges 25 (FIG. 5) of major ribs 19 and the lower edges 28 of minor ribs 12 lie in the same plane when the screen 10 is flat. However, the screen 10 is flexible and the lower edges 25 and 28 will conform to the curvature of the bed of a vibratory screening machine when it is in an operating position thereon.

The major structural undulations 11 include the major ribs 19 which extend between and are molded integrally with end caps 15, and they are also molded integrally with the minor ribs 20, as described above. In addition, each mirror image side 30 of each undulation 11 includes an outer surface and an inner surface. Each side 30 also includes a screen configuration having upper slots 31 (FIG. 8) and lower slots 32. The slots 31 and 32 are separated by a central molded portion 33 which also extends the entire length of each undulation 11 and is molded integrally with end caps 15 and minor rib triangles 21.

The structural stability of the major undulations 11 is enhanced by internal ribs 34 (FIGS. 5, 8 and 10) which are molded integrally with portions 33 at the inner surface of each side 30. Ribs 34 extend between and their ends are molded to triangles 21 of minor ribs 20. They are present throughout the entire length of each major structural undulation 11, and the ribs 34 adjacent end caps 15 are molded integrally with and terminate at end caps 15.

The minor structural undulations 12 include mirror image sides 35 (FIG. 9) each having an outer surface an an inner surface and each including a screen configuration having upper elongated slots 37 and lower elongated slots 39. The slots 37 and 39 on each mirror image side 35 are separated by a central molded portion 40 which extends between and is molded integrally with end caps 17 and with trapezoidal portions 18 of minor ribs 20.

Figure 9:
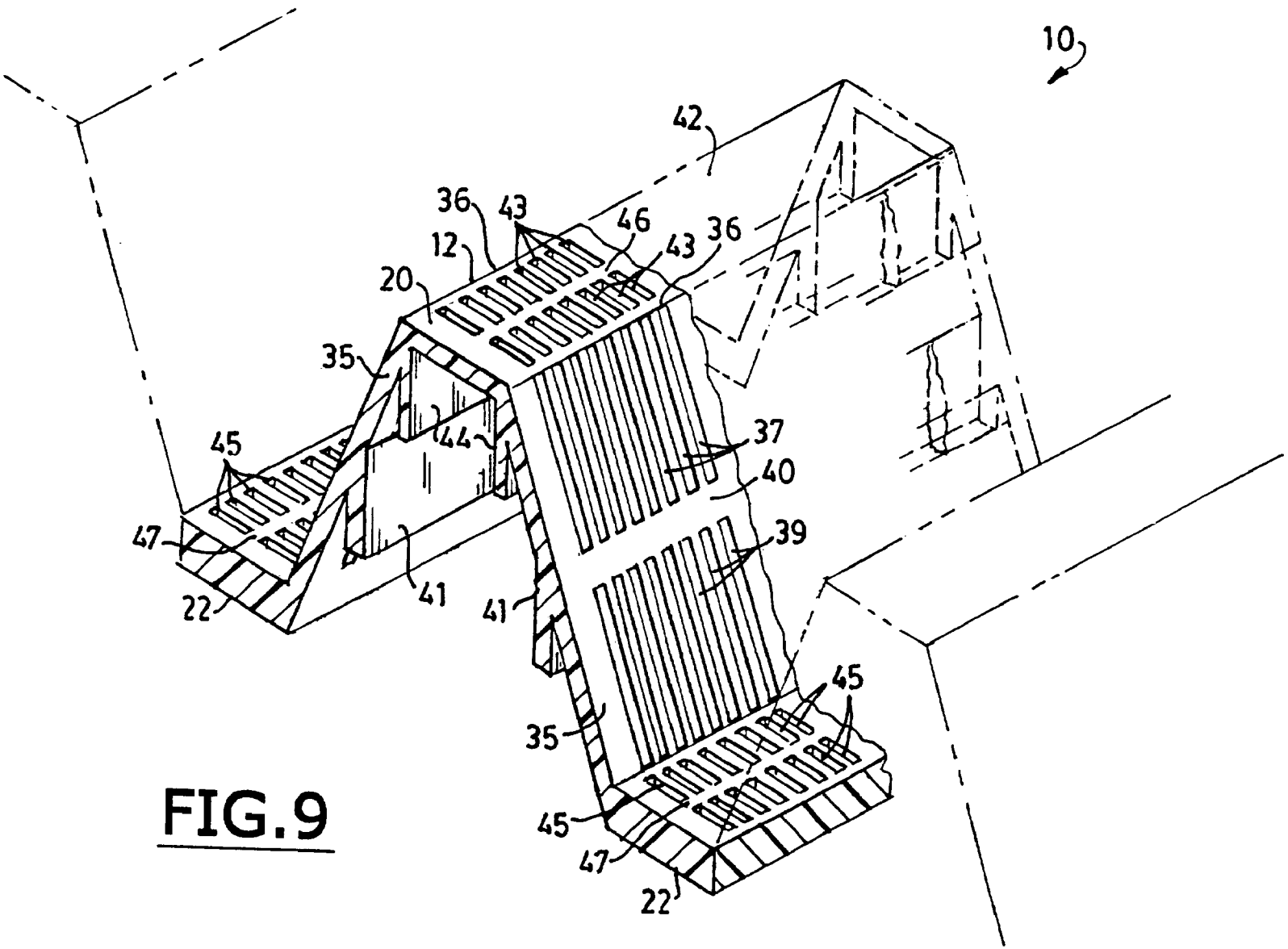
FIG. 9 is an enlarged fragmentary perspective cross sectional view of a minor structural undulation with the rib structure therein taken substantially along line 9-9 of FIG. 7.
Figure 10:
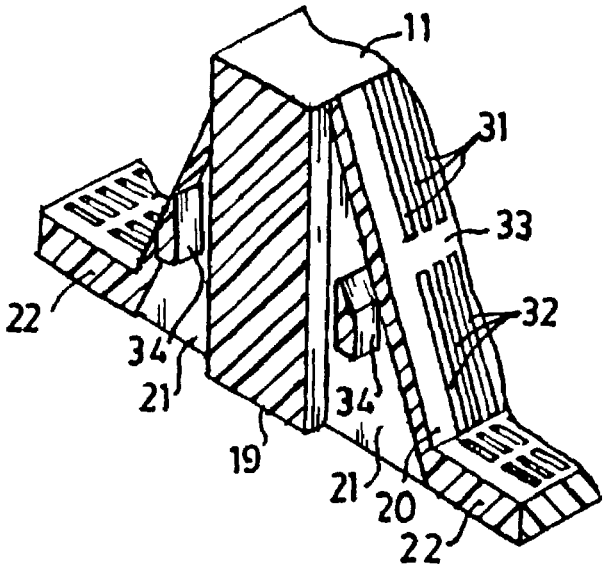
FIG. 10 is an enlarged fragmentary perspective cross sectional view of a major structural undulation with the rib structure therein taken substantially along line 10-10 of FIG. 6 and with the sides of the major undulation cross-sectioned immediately prior to their intersection with the minor ribs.

The structural stability of the minor undulations 12 is enhanced by internal ribs 41, which extend downwardly from the inner surface of side 35 at central portion 40. Each rib 41 has an upper portion molded integrally with portion 40 and a lower free end (FIGS. 5, 9 and 11). Each rib 41 extends between adjacent trapezoidal portions 18. The ends of each rib 41 are molded integrally with trapezoidal portions 18 at their junctions with central molded portions 40. Ribs 41 are present throughout the entire length of each undulation 12, and those adjacent end caps 17 and are molded integrally with and terminate at end caps 17.

The peak 42 of each undulation 12 includes a screen configuration having two rows of slots 43 (FIG. 9) which are separated by central molded portion 46. However, the peaks 48 (FIG. 5) of major undulations 11 are the tops of major ribs 19, and they are not slotted. Each peak 42 extends between and is molded integrally with the end caps 17 at the opposite ends of each minor undulation 12.

The structural stability of minor undulations 12 is enhanced by internal ribs 44 which have their upper ends molded integrally with edges 36 (FIG. 9) of each peak 42 and very small uppermost portions of sides 35 proximate their junctions with peaks 42 and they have lower free ends. Ribs 44 extend between trapezoidal portions 18, and the ends of ribs 44 are molded to trapezoidal portions 18 proximate their junctions with peaks 42 (FIG. 11). Ribs 44 are present throughout the entire length of each undulation 12, and those adjacent end caps 17 have their ends molded integrally with end caps 17.

At the connecting portions at 22 between the undulations 11 and 12, the screen 10 includes a screen configuration having two rows of slots 45 (FIGS. 8 and 9) which are separated by a molded portion 47 therebetween which extends to the edges of the screen and is molded integrally therewith.

Figure 4:
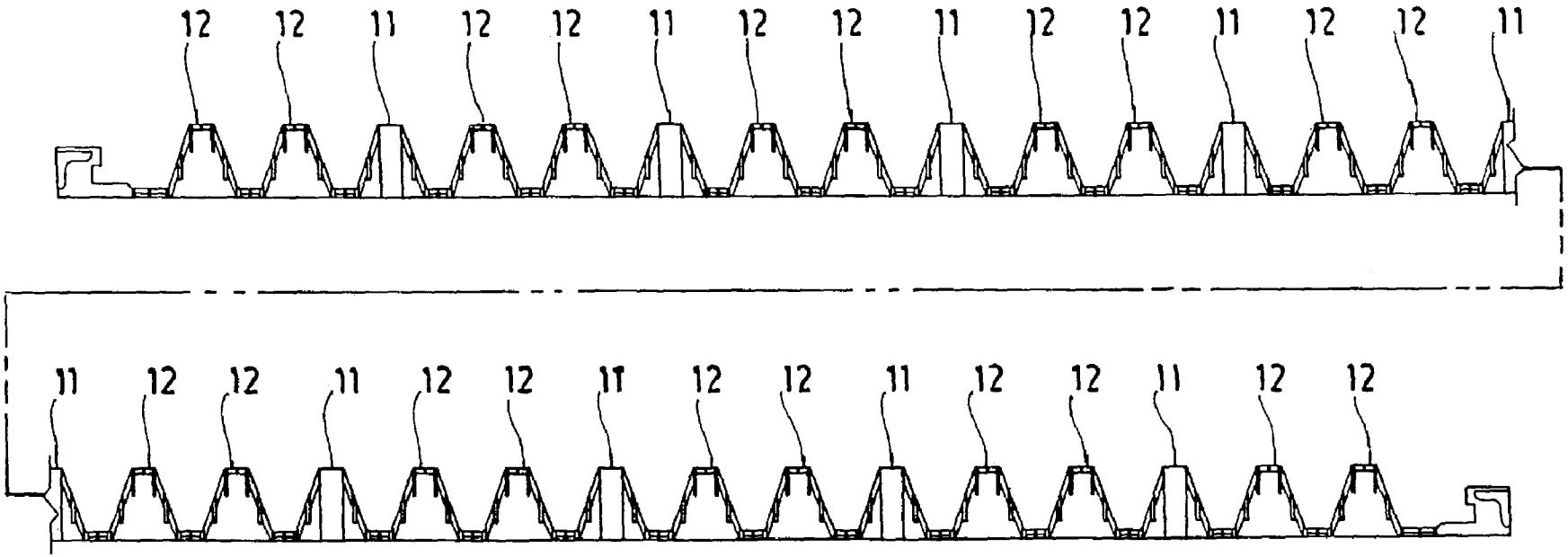
FIG. 4 is a schematic cross sectional view taken substantially along line 5-5 of FIG. 2 of a plastic undulating screen showing the orientation of the major and minor undulations throughout the entire length of the screen.

The molded screen 10 is substantially symmetrical about both of its horizontal and vertical centerlines. A screen has been designed which has overall dimensions of 41½" by 27½". It contains nine major undulations 11 and twenty minor undulations 12 (FIG. 4). The major and minor undulations are ¾" high from the tops of screen portions 22 to their peaks, such as 42. They are 1" wide at their bases and 5/16" wide at their peaks. The portions 22 are 0.33" wide and ⅛" deep. The slots 31, 32, 37 and 39 are 0.7 mm wide and ⅜" long. The slots 43 are 0.7 mm wide and 3/16" long. The slots 45 are 0.7 mm wide and ⅛" long. The screen was designed to screen 0.7 mm or under particles. At the screening areas, namely, the portions of the screen immediately adjacent the screen openings, the screen is 0.07" thick. However, it will be appreciated that the width of the slots can be dimensioned differently, as required to screen other size particles. Also, all the other dimensions can be changed, as desired, within the limits of operability. As noted above, the screen 10 is flexible when it is unsupported. However, it becomes more rigid when it is tensioned on and supported by the bed of a vibratory screening machine on which it is operatively installed.

While a preferred embodiment of the present invention has been disclosed, it will be appreciated that it is not limited thereto but may be otherwise embodied within the scope of the following claims.

The invention claimed is:

1. An undulating molded plastic vibratory screen comprising:

a base, a plurality of spaced substantially parallel elongated undulations on said base, and screen configurations on said undulations said base includes a plurality of first ribs extending longitudinally internally of at least certain of said undulations, and a plurality of second ribs extending crosswise to said plurality of first ribs and molded integrally therewith wherein said plurality of first ribs are located in first undulations which are spaced from each other by at least one second undulation which does not have a first rib therein.

2. An undulating molded plastic vibratory screen comprising:

a base, a plurality of spaced substantially parallel elongated undulations on said base, and screen configurations on said undulations said base includes a plurality of first ribs extending longitudinally internally of at least certain of said undulations, and a plurality of second ribs extending crosswise to said plurality of first ribs and molded integrally therewith wherein said screen configurations comprise sides of said undulations and are molded integrally with said second ribs wherein said undulations have inner surfaces and outer surfaces, third ribs molded integrally with said second ribs and extending longitudinally of said undulations, and said third ribs having first edges molded integrally with said inner surfaces and second edges which are free of said inner surfaces.

3. The undulating molded plastic vibratory screen as set forth in claim 2 wherein said third ribs are also molded to said second ribs at the junctions of said inner surfaces with said second ribs.

4. An undulating molded plastic vibratory screen comprising:

a base, a plurality of spaced substantially parallel elongated undulations on said base, and screen configurations on said undulations said base includes a plurality of first ribs extending longitudinally internally of at least certain of said undulations, and a plurality of second ribs extending crosswise to said plurality of first ribs and molded integrally therewith wherein said screen configurations comprise sides of said undulations and are molded integrally with said second ribs including a plurality of third ribs in said first undulations, and a plurality of fourth ribs in said second undulations.

5. The undulating molded plastic vibratory screen as set forth in claim 4 wherein said third ribs are molded integrally with said second ribs and extend longitudinally of said first undulations, and wherein said first undulations have inner and outer surfaces, and said third ribs have first edges molded integrally with said inner surfaces of said first undulations and second edges which are free of said inner surfaces of said first undulations.

6. The undulating molded plastic vibratory screen as set forth in claim 5 wherein said third ribs are also molded to said second ribs at the junctions of said inner surfaces with said second ribs.

7. The undulating molded plastic vibratory screen as set forth in claim 5 wherein said first undulations have lower edges and higher edges, and wherein said first undulations have opposite sides, and wherein said third ribs are molded to said inner surfaces of each of said opposite sides intermediate said higher and lower edges of said first undulations.

8. The undulating molded plastic vibratory screen as set forth in claim 4 wherein said fourth ribs are molded integrally with said second ribs and extend longitudinally of said second undulations, and wherein said second undulations have inner and outer surfaces, and said fourth ribs have first edges molded integrally with said inner surfaces of said second undulations and second edges which are free of said inner surfaces of said second undulations.

9. The undulating molded plastic vibratory screen as set forth in claim 8 wherein said first edges of said fourth ribs are also molded to said second ribs at the junctions of said inner surfaces of said second undulations with said second ribs.

10. The undulating molded plastic vibratory screen as set forth in claim 9 wherein said second undulations have lower edges and higher edges, and wherein said second undulations have opposite sides, and wherein said fourth ribs are molded to each of said inner surfaces of said opposite sides of said second undulations proximate said higher edges, and fifth ribs are molded to each of said inner surfaces of said opposite sides of said second undulations intermediate said lower and higher edges.

11. The undulating molded plastic vibratory screen as set forth in claim 10 wherein said third ribs are molded integrally with said second ribs and extend longitudinally of said first undulations, and wherein said first undulations have inner and outer surfaces, and wherein said third ribs have first edges molded integrally with said inner surfaces of said first undulations and second edges which are free of said inner surfaces of said first undulations.

12. The undulating molded plastic vibratory screen as set forth in claim 11 wherein said third ribs are also molded to said second ribs at the junctions of said inner surfaces with said second ribs.

13. The undulating molded plastic vibratory screen as set forth in claim 12 wherein said first undulations have lower edges and higher edges, and wherein said first undulations have opposite sides, and wherein said third ribs are molded to said inner surfaces of each of said opposite sides intermediate said higher and lower edges of said first undulations.

14. An undulating molded plastic vibratory screen comprising:

a base, a plurality of spaced substantially parallel elongated undulations on said base, and screen configurations on said undulations said base includes a plurality of first ribs extending longitudinally internally of at least certain of said undulations, and a plurality of second ribs extending crosswise to said plurality of first ribs and molded integrally therewith wherein said first ribs have first higher edges and first lower edges, and wherein said second ribs have second higher edges and second lower edges, and wherein said first and second lower edges lie in substantially the same plane.

15. The undulating molded plastic vibratory screen as set forth in claim 14 wherein said first and second undulations have first and second peaks, respectively, and wherein said first higher edges of said first ribs terminate at said first peaks, and said second higher edges of said second ribs terminate at both said first and second peaks.

16. The undulating molded plastic vibratory screen as set forth in claim 15 wherein said first and second undulations are trapezoidal in cross section.

17. An undulating molded plastic vibratory screen comprising:

a base, a plurality of spaced substantially parallel elongated undulations on said base, and screen configurations on said undulations said base includes a plurality of first ribs extending longitudinally internally of at least certain of said undulations, and a plurality of second ribs extending crosswise to said plurality of first ribs and molded integrally therewith wherein said first undulations have first opposite ends, and wherein said second undulations have second opposite ends, first end caps molded integrally with said first opposite ends, second end caps molded integrally with said second opposite ends, and wherein said first ribs have third opposite ends which are molded integrally with said first end caps.

18. An undulating molded plastic vibratory screen comprising:

a base, a plurality of spaced substantially parallel elongated undulations on said base, and screen configurations on said undulations said base includes a plurality of first ribs extending longitudinally internally of at least certain of said undulations, and a plurality of second ribs extending crosswise to said plurality of first ribs and molded integrally therewith wherein said screen configurations comprise sides of said undulations and are molded integrally with said second ribs, and wherein said screen configurations also comprise the tops of said second undulations.

19. An undulating molded plastic vibratory screen comprising a base, a plurality of spaced substantially parallel elongated undulations on said base, and screen configurations on said undulations said base includes a plurality of first ribs extending longitudinally internally of at least certain of said undulations, and a plurality of second ribs extending crosswise to said plurality of first ribs and molded integrally therewith wherein said second undulations include inner and outer sides, and wherein said second undulations have lower edges and higher edges, third ribs secured to said inner sides intermediate said lower and higher edges, and fourth ribs secured relative to said inner sides proximate said higher edges, and said third and fourth ribs extending longitudinally of said second undulations.

20. The undulating molded plastic vibratory screen as set forth in claim 19 wherein said third and fourth ribs extend between and are molded integrally with said second ribs.

21. The undulating molded plastic vibratory screen as set forth in claim 19 wherein said first undulations include second inner and outer sides, and wherein said first undulations have second lower and higher edges, and fifth ribs secured to said second inner sides intermediate said second lower and higher edges.

22. The undulating molded plastic vibratory screen as set forth in claim 21 wherein said fifth ribs extend between and are molded integrally with said second ribs.

23. The undulating molded plastic vibratory screen as set forth in claim 22 wherein said third and fourth ribs extend between and are molded integrally with said second ribs.

24. The undulating molded plastic vibratory screen as set forth in claim 23 wherein said screen configurations also comprise the tops of said second undulations.

* * * * *